US011913750B1

(12) United States Patent
Cudal et al.

(10) Patent No.: US 11,913,750 B1
(45) Date of Patent: Feb. 27, 2024

(54) AIRSOFT ADAPTER ASSEMBLY

(71) Applicants: Arren Cudal, West Palm Beach, FL (US); Renfield Cudal, West Palm Beach, FL (US)

(72) Inventors: Arren Cudal, West Palm Beach, FL (US); Renfield Cudal, West Palm Beach, FL (US)

( * ) Notice: Subject to any disclaimer, the term of this patent is extended or adjusted under 35 U.S.C. 154(b) by 0 days.

(21) Appl. No.: 18/327,010

(22) Filed: May 31, 2023

(51) Int. Cl.
*F41B 11/50* (2013.01)

(52) U.S. Cl.
CPC ..... *F41B 11/50* (2013.01)

(58) Field of Classification Search
CPC ..... F41B 11/50; F41B 11/55; F41B 11/60; F41B 11/62; F41B 11/721; F41B 11/722; F41A 9/83
USPC ..... 124/45, 51.1, 56, 71, 82; 42/88
See application file for complete search history.

(56) References Cited

U.S. PATENT DOCUMENTS 2,307,015 A * 1/1943 Boynton ..... F41B 11/68 124/73
4,614,052 A * 9/1986 Brown ..... F41A 9/65 42/87
6,754,987 B1 * 6/2004 Cheng ..... F41A 9/83 42/87
6,810,616 B2 * 11/2004 Tal ..... F41A 9/83 42/87
7,565,902 B2 * 7/2009 Levin ..... F41B 11/00 124/71
7,921,836 B2 * 4/2011 Tran ..... F41B 11/55 124/49
8,100,119 B2 * 1/2012 Hall ..... F41B 11/50 124/71
8,931,199 B1 * 1/2015 Cauley, Jr. ..... F41A 9/83 42/87
9,207,038 B2 * 12/2015 Gilley ..... F41A 9/83
9,212,859 B1 * 12/2015 Tal ..... F41A 9/83
9,574,836 B1 * 2/2017 Cauley, Jr. ..... F41A 9/83
9,631,891 B2 * 4/2017 Sullivan ..... F41B 11/62
9,658,027 B2 * 5/2017 Stevens ..... F41B 11/51
10,139,176 B1 * 11/2018 Witecha ..... F41A 9/83
10,619,968 B2 * 4/2020 Culiat ..... F41B 11/681
10,746,487 B2 * 8/2020 Bian ..... F41A 9/83
2007/0012304 A1 * 1/2007 van Dorsser ..... F41B 11/53 124/51.1
2010/0000505 A1 * 1/2010 Yeh ..... F41B 11/53 124/51.1
2010/0224180 A1 * 9/2010 Tippmann, Jr. ..... F41B 11/62 124/74

(Continued)

FOREIGN PATENT DOCUMENTS

DE 102019001269 A1 * 8/2020

*Primary Examiner* — Alexander R Niconovich
(74) *Attorney, Agent, or Firm* — Diana Mederos; Mederos Legal, PLLC

(57) ABSTRACT

An airsoft adapter assembly capable of being removably attached to an airsoft magazine and an airsoft reservoir. The airsoft adapter links an airsoft magazine to a reservoir to allow for interchangeability for attaching different types of reservoirs to an airsoft gun magazine or for attaching the same reservoir to several different configurations of airsoft guns and their coordinating magazine. The airsoft adapter makes a sufficiently airtight seal for high performance projectile shooting with improved projectile conduits and pressurized flow conduits.

13 Claims, 20 Drawing Sheets

(56) References Cited

U.S. PATENT DOCUMENTS

| | | | | |
|---|---|---|---|---|
| 2014/0033592 | A1* | 2/2014 | Fiorucci | F41A 9/83<br>42/87 |
| 2015/0176941 | A1* | 6/2015 | Pullens | F41B 11/55<br>29/401.1 |
| 2015/0211827 | A1* | 7/2015 | Boza | F41B 11/55<br>29/401.1 |

* cited by examiner

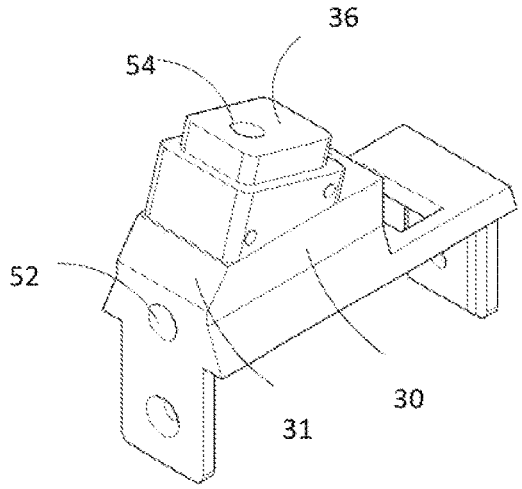
Fig. 7a
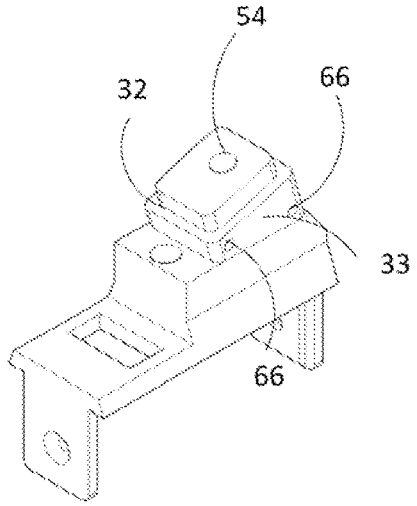
Fig. 7b
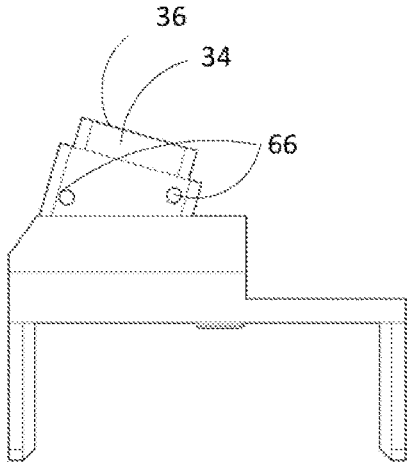
Fig. 7c
Fig. 7d
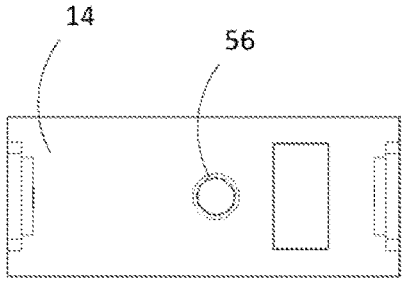

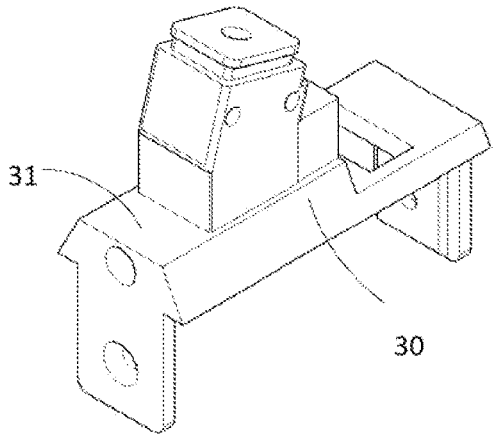
Fig. 9a
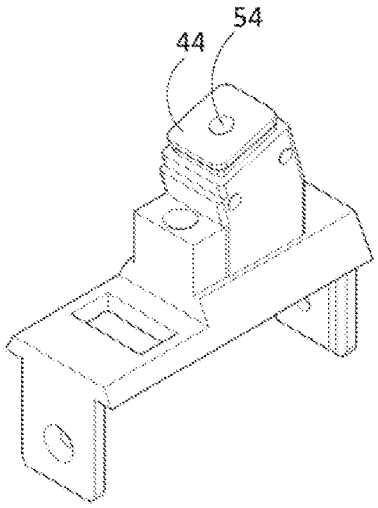
Fig. 9b
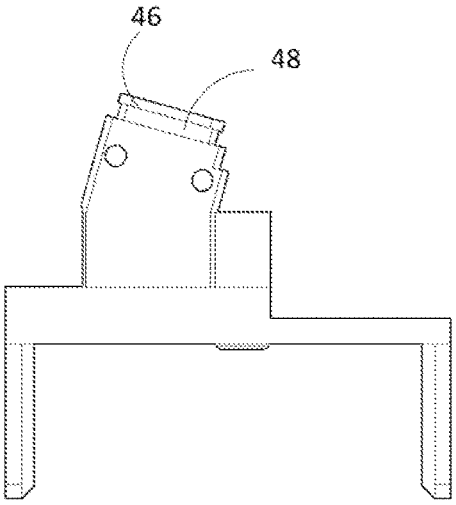
Fig. 9c
Fig. 9d
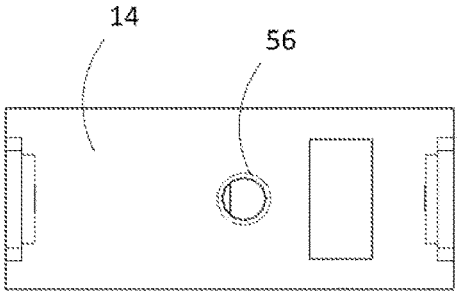

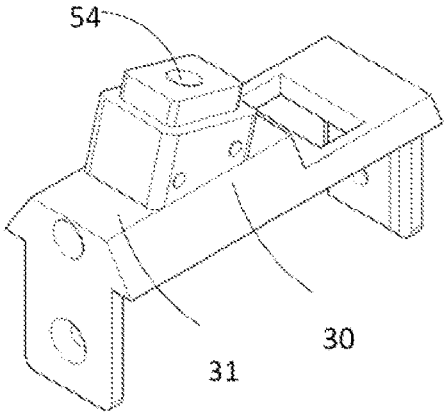
Fig. 10a
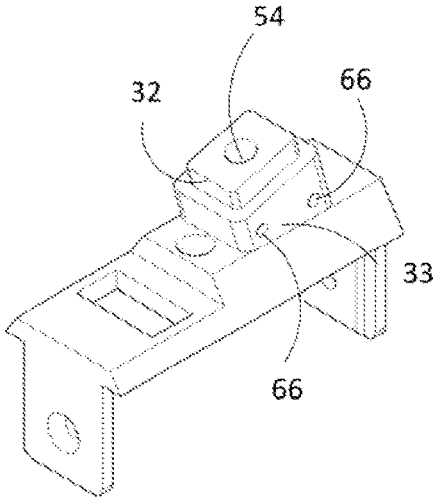
Fig. 10b
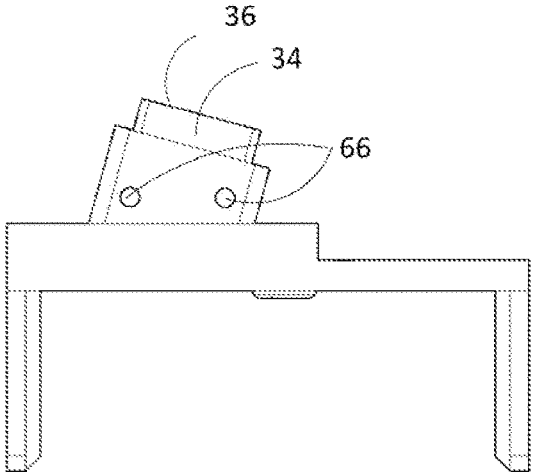
Fig. 10c
Fig. 10d
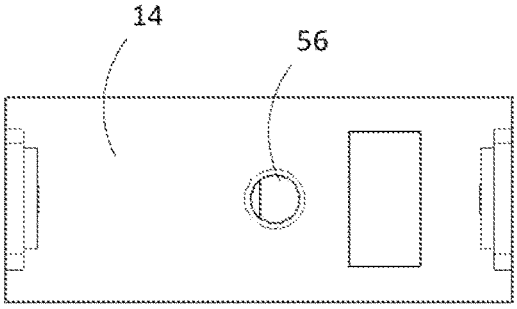

AIRSOFT ADAPTER ASSEMBLY

FIELD OF THE DISCLOSURE

The present disclosure relates to an adapter for airsoft guns. More specifically, the airsoft adapter removably attaches to an airsoft ammunition magazine and to an airsoft ammunition reservoir to allow for optimization of high-pressure air flow and projectile flow for increased performance for game play.

BACKGROUND

Airsoft guns are a type of toy weapon used to simulate an actual firearm. Airsoft guns can be in a pistol, rifle, or semi-automatic gun format and use pellets for ammunition. Airsoft guns are used in a manner similar to that of paintball guns—a group of players simulate war or artillery strategy games in designated airsoft zones or venues. Players who have faster, more powerful guns and with the most ammunition will benefit over other players.

As with most guns, airsoft guns have the basic parts of a trigger, a stock, a hand grip, a barrel, and a magazine. Airsoft guns can function mechanically by the use of springs to launch projectile, pneumatically by the use of high-pressure air, or electronically by an electric motor gearbox. Airsoft guns that employ the use of high pressure or compressed air are the most widely used due to their combination of performance and affordability. The compressed air is used to fire projectiles when a trigger is activated.

Modifications to airsoft guns and airsoft gun accessories and peripherals are commonly done. Some airsoft guns may even be custom ordered but are expensive. As a more affordable option, standard airsoft guns may be customized through the use of adapters. For example, adapters can be made to connect a standard magazine to a high-capacity ammunition reservoir.

The problem with adapters generally available is their propensity to become jammed with projectiles or ammunition, leak air, or not fit properly. Such problems negate any benefits of using an adapter in the first place and can lead to injury.

SUMMARY

What is needed is an optimized airsoft adapter that is configured to be removably attached to an airsoft ammunition magazine and to an airsoft ammunition reservoir for extended and enhanced airsoft game play. In an assembled state, such an airsoft adapter sits in between the airsoft ammunition magazine and the airsoft ammunition reservoir. The airsoft adapter has optimized interior components configured to allow safe and reliable flows of pressurized air and projectiles through the airsoft adapter.

The present disclosure provides an airsoft adapter comprising a top portion with a magazine adapter piece that fits in or around the open end of an airsoft ammunition magazine. The airsoft adapter comprises a bottom portion with an appendage on either end for removably attaching the adapter to a docking bay of an airsoft ammunition reservoir with fasteners. The airsoft adapter assembly comprises a magazine fastening portion, an HPA output, a projectile conduit, and a magazine fastening hole.

The airsoft adapter has a crown on the top portion that fits into the open end of a magazine and ports to a compressed air source. The airsoft adapter-magazine complex can be attached to a reservoir by snapping a rectangular opening on the adapter over a corresponding area on a reservoir and attaching the adapter to the reservoir with at least one fastener inserted through at least one fastener hole and into at least one reservoir fastener hole on the reservoir to form a magazine-adapter-reservoir complex. The magazine distal end is inserted into an airsoft gun. The fasteners are removed to disconnect the adapter from the reservoir and can be connected to a different reservoir or accessory without needing to change the original airsoft gun or magazine.

BRIEF DESCRIPTION OF THE DRAWINGS

FIGS. 7*a*, 7*b*, 7*c*, and 7*d* illustrate a left perspective view, right perspective view, side view, and bottom view, respectively, of another embodiment of an airsoft adapter assembly.

FIGS. 9*a*, 9*b*, 9*c*, and 9*d* illustrate a left perspective view, right perspective view, side view, and bottom view, respectively, of another embodiment of an airsoft adapter assembly.

FIGS. 10*a*, 10*b*, 10*c*, and 10*d* illustrate a left perspective view, right perspective view, side view, and bottom view, respectively, of another embodiment of an airsoft adapter assembly.

DETAILED DESCRIPTION

Figure 1:
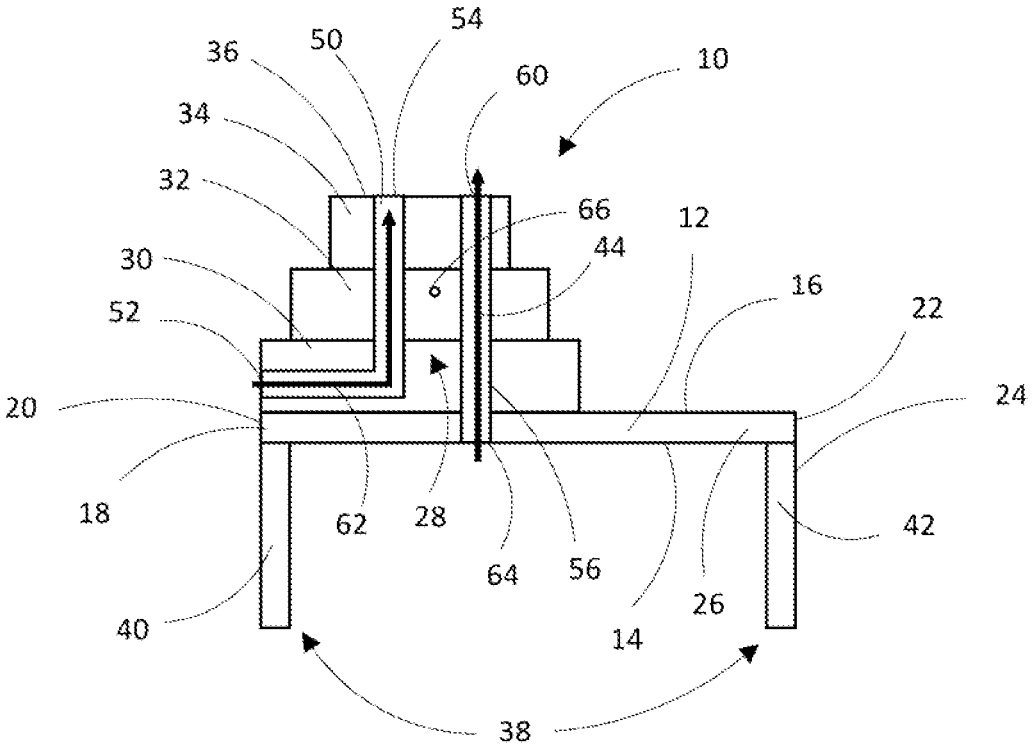
FIG. 1 illustrates a cross-section of an exemplary airsoft adapter assembly according to one embodiment.

The present disclosure provides for an airsoft adapter assembly. The airsoft adapter assembly is removably attached to an airsoft magazine and to an airsoft reservoir. The airsoft adapter is presented in embodiments according to configurations of the different types of airsoft gun models. The airsoft adapter links an airsoft magazine to a reservoir to allow for interchangeability for attaching different types of reservoirs to an airsoft gun magazine or for attaching the same reservoir to several different configurations of airsoft guns and their coordinating magazines. Rather than purchasing and loading a different reservoir for each type of airsoft gun and its magazine, a player only needs to exchange the adapter.

The airsoft adapter creates a sufficiently airtight seal between a magazine and a reservoir for high performance projectile shooting. More specifically, internal configurations of a high-pressure air conduit and projectile conduit promote fluidity and reduce projectile jamming.

Generally, the adapter has a top portion with a magazine adapter piece and a bottom portion with a docking bay. The adapter has an HPA input, at least one gas magazine fastener hole, an HPA output, a projectile conduit, and at least one magazine fastening hole.

Preferred embodiments may be comprised of a single piece of molded or three-dimensionally printed material such as plastics, woods, resins, and composite materials suitable for airsoft gun adapters. However, some embodiments may be composed of sub parts glued or welded together.

The adapters disclosed herein have been tested and optimized for improved performance over adapters found in the prior art. More specifically, the adapters disclosed herein provide improved airflow to facilitate the launching of projectiles without reduced velocity or distance.

Definitions

"adapter" as used herein means an airsoft adapter assembly.

"HPA" as used herein means high pressured air.

"fastener" as used herein means a screw or a pin capable of being threaded through a hole or opening and capable of either fixably or removably attaching objects together.

NUMERALS IN THE FIGURES

The following list refers to the figures:

10. Adapter
12. Base plate
14. Bottom surface of the base plate
16. Top surface of the base plate
18. Proximal end
20. Proximal end surface
22. Distal end
24. Distal end surface
26. Flat portion
28. Magazine fastening portion
30. First protruding segment
31. Top surface of the first protruding segment
32. Second protruding segment
33. Side surface of the second protruding segment
34. Third protruding segment
36. Top surface of the magazine fastening portion
37. Cavity
38. Reservoir fastening portion
40. Proximal appendage
42. Distal appendage
44. Crown
46. Crown edge
48. Gasket groove
50. HPA conduit
52. HPA inlet
54. HPA outlet
56. Projectile conduit
58. Projectile conduit inlet
60. Projectile conduit outlet
62. HPA flow
64. Projectile flow
66. Magazine fastening hole
68. Reservoir fastening hole
70. Rectangular opening
72. Magazine distal end
74. Airsoft magazine
76. Magazine open end
78. Gasket
80. HPA fitting
82. Magazine fastening rod
84. Reservoir fastening screw
86. Airsoft ammunition reservoir
88. Reservoir docking bay
90. Reservoir fastener hole
92. Airsoft gun

DESCRIPTION

In the following sections, detailed descriptions of examples and methods of the disclosure will be given. The description of both preferred and alternative examples are exemplary only, and it is understood that to those skilled in the art that variations, modifications, and alterations may be apparent. It is therefore to be understood that the examples do not limit the broadness of the aspects of the underlying disclosure as defined by the claims.

FIG. 1 shows a schematic cross-section of an airsoft adapter according to a first embodiment. The airsoft adapter 10 comprises a base plate 12 having a base plate bottom surface 14, a base plate top surface 15, a proximal end 18 with a proximal end surface 20, and a distal end 22 with a distal end surface 24. All surfaces of the base plate 12 may be rectangular. The end surfaces 20 and 24 may be orthogonal side surfaces which connect the top and bottom surfaces 14, 16 on the proximal and distal ends 18, 22, respectively.

Figure 18:
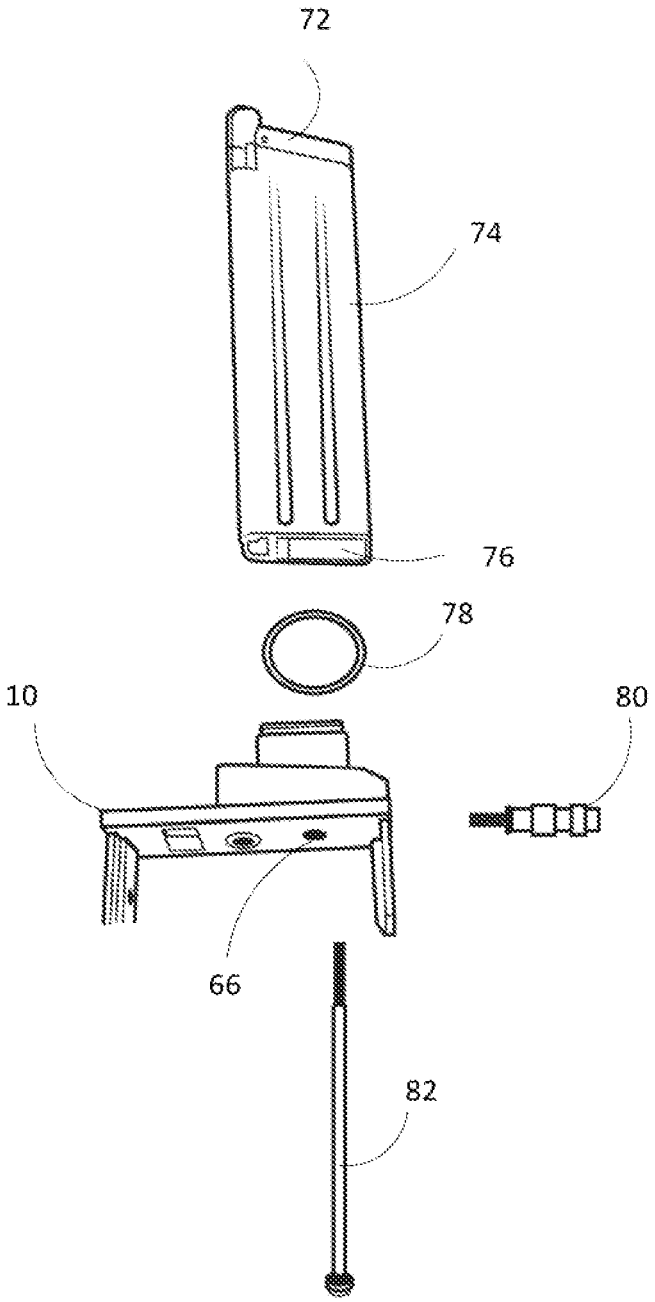
FIG. 18 illustrates an exploded view of an exemplary adapter and magazine.
Figure 19:
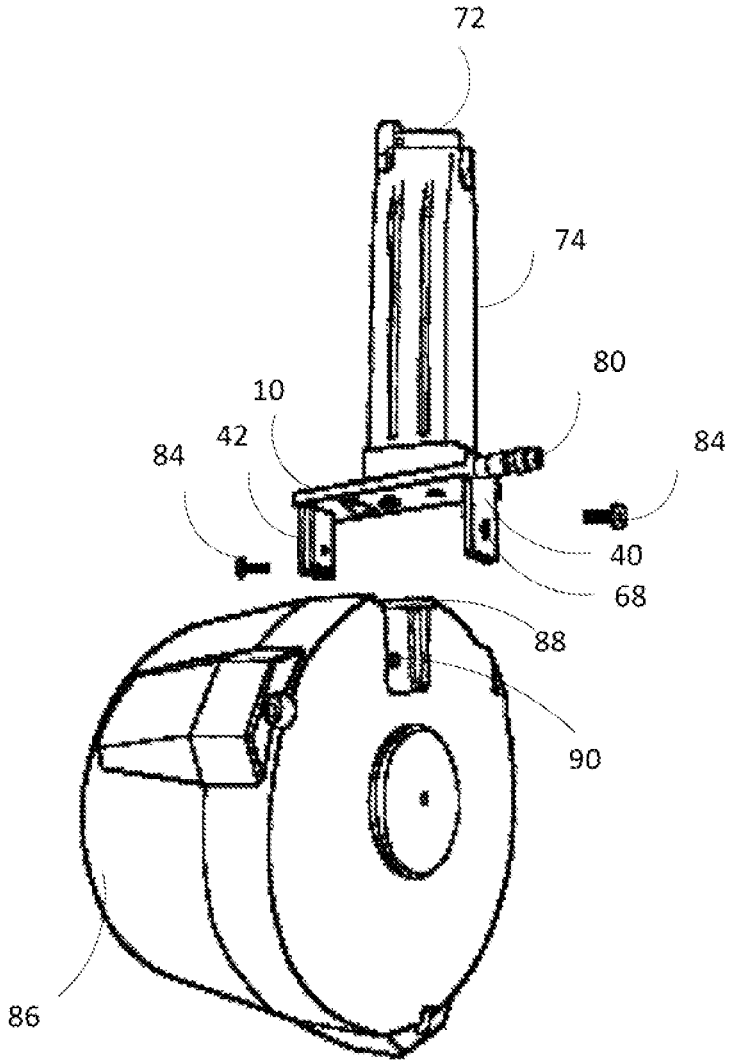
FIG. 19 illustrates an exploded view of an exemplary magazine-adapter complex and a reservoir.
Figure 20:
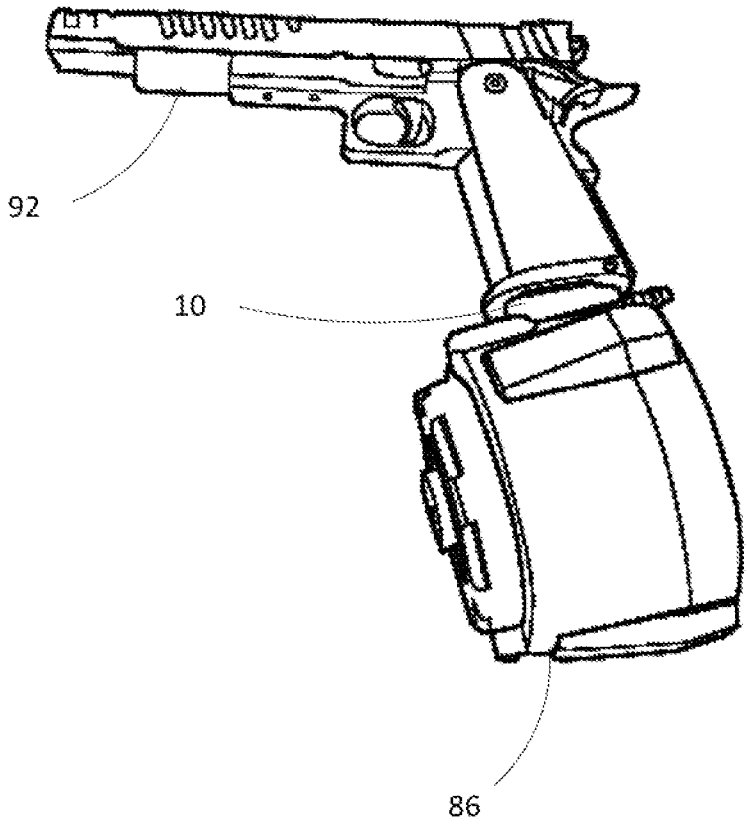
FIG. 20 illustrates a perspective view of an exemplary airsoft gun with a magazine-adapter-reservoir complex.

The airsoft adapter 10 may further comprise a magazine fastening portion 28 provided on the top surface 16. The magazine fastening portion 28 is configured to connect the adapter 10 with a complementary magazine open end 76 of an airsoft magazine 74, as shown in FIGS. 18-20. The magazine fastening portion 28 comprises a first protruding segment 30, a second protruding segment 32, and a third protruding segment 34 which are arranged in a stacked configuration. In the shown embodiment, the first-third protruding segments 30-34 are configured and stacked to achieve a pyramid-like configuration of the magazine fastening portion 28. To secure the adapter 10 to the magazine open end 76 of an airsoft magazine 74, the magazine fastening portion 28 comprises a magazine fastening hole 66 in the second protruding segment 32.

On its bottom surface 14, the adapter 10 comprises a reservoir fastening portion 38 for releasably securing the adapter 10 to an airsoft ammunition reservoir as shown in FIGS. 19-20. The reservoir fastening portion 38 may comprise a proximal appendage 40 and a distal appendage 42 to releasably secure the adapter 10 to complementary reservoir docking bays 88 of the airsoft ammunition reservoir 86, as shown in FIGS. 19-20. The reservoir fastening portion 38 protrudes from the base plate 12 in an opposite direction than the magazine fastening portion 28.

On its interior, the airsoft adapter 10 comprises an HPA conduit 50 and a projectile conduit 56. The HPA conduit 50 runs through the magazine fastening portion 28 and is configured to feed an externally supplied HPA to the magazine. The HPA conduit 50 has an elbow-shape and comprises an HPA inlet 52 and an HPA outlet 54. The HPA inlet 52 is provided on the proximal end surface of the magazine fastening portion, and the HPA outlet 54 is provided on a top surface 36 of the magazine fastening portion 28. In this configuration, the proximal end surface of the magazine fastening portion is an extension of the proximal end surface 20 of the base plate 12.

The elbow-shape of the HPA conduit 50 allows to reduce turbulence in the flow of pressurized air 62, which can minimize pressure loss and improve flow efficiency. Further, the elbow shape increases HPA flow stability, reducing the risk of vibration and wear on the system components. Finally, the elbow shape allows changing flow direction in a compact space which can be useful in tight installations where space is limited. Hence, with the elbow-shaped HPA conduit 50, a safe and reliable adaptive connection of various airsoft ammunition reservoirs to a given airsoft ammunition magazine can be achieved. This allows the player to engage another player longer without having to interrupt the engagement due to magazine changes.

The projectile conduit 56 of the adapter 10 is a straight through-hole and comprises a projectile inlet 64 and a projectile outlet 60. The projectile inlet 64 is provided on the bottom surface 14 of the base plate 12, and the projectile outlet 60 is provided on the top surface 36 of the magazine fastening portion 28.

Providing the projectile conduit 56 as a straight through-hole reduces the number of corners and bends, which allows projectile flow 64 through the adapter 10 with minimal restriction, which results in a better and more consistent projectile feeding compared to commercially available adapters. A straight through-hole was shown to reduce the incidences of projectiles getting stuck. Furthermore, durability of the adapter 10 was increased compared to commercially available adapters. Furthermore, the configuration of the vertical linear projectile conduit and elbow-shaped HPA conduit, arranged on either side of a magazine fastening hole made cleaning the adapter easier since debris accumulation was reduced. The straight through-hole design of the projectile conduit 56 is also simpler to manufacture compared to more complex shapes, which lowered the cost of production compared to commercially available adapters.

The adapter 10 further comprises a first appendage 22 and a second appendage 23. The first appendage 22 protrudes from the base plate on the proximal end in an opposite direction from the magazine fastening portion. The second appendage 23 protrudes from the base plate on the distal end in the same direction as the first appendage 22. The first and second appendages 22, 23 are configured to removably attach a magazine reservoir 66 to the adapter 10, as shown in FIGS. 19 and 20.

In preferred embodiments, an HPA conduit inlet presents at the proximal end of an adapter, above the proximal appendage, at the first protruding segment, and below a the second protruding segment. The HPA conduit has an elbow-shaped configuration that tunnels horizontally through the first protruding segment and vertically up through the second protruding segment and third protruding segment. The HPA outlet presents at the top surface of the magazine fastening portion of the third protruding segment.

In preferred embodiments, the magazine fastening portion comprises a plurality of step-stacked protruding segments. The first protruding segment is positioned on top of the top surface of the base plate and has a width less than that of the base plate where width is the distance between proximal and distal appendages. Subsequent protruding segments are stacked, each having a width lesser than the preceding protruding segment.

In preferred embodiments, the projectile conduit may present with an opening at a bottom of the base plate at the reservoir fastening portion and extend upward toward the magazine fastening portion and through at least one protruding segment. The projectile conduit outlet presents at the top surface of the magazine fastening portion. The projectile conduit outlet is presented parallel to the HPA outlet. The projectile conduit outlet may be positioned between 0.2 to 1.5 mm from an edge of the distal end of the uppermost protruding segment of the magazine fastening portion. The HPA outlet may be positioned between 1.5 mm and 2.5 mm from an edge of the proximal end of the uppermost protruding segment of the magazine fastening portion.

FIGS. 2*a*-2*d* show several views of an exemplary airsoft adapter assembly according to another embodiment. The embodiment shown in FIGS. 2*a*-2*d* comprise the same parts as the embodiment shown in FIG. 1. The same explanations, definitions, and reference numbers provided in the context of FIG. 1 also apply to the embodiments shown in the subsequent FIGS. 2-20 where applicable.

The magazine fastening portion 28 comprises a second protruding segment 32 in a tilted configuration. The third protruding segment 34 is provided in the shape of a straight crown 44 with a tilted top surface 36. The HPA inlet 52 and the HPA outlet 54 have a circular cross-section.

The magazine fastening portion 28 comprises two magazine fastening holes 66 on each of its lateral side surfaces for releasably fastening the adapter 10 to an airsoft magazine. The base plate 12 comprises a rectangular opening 70, and the proximal and distal appendages 40, 42, each comprise a reservoir fastening hole 68 for releasably fastening the airsoft adapter 10 to an airsoft ammunition reservoir.

Figure 2A:
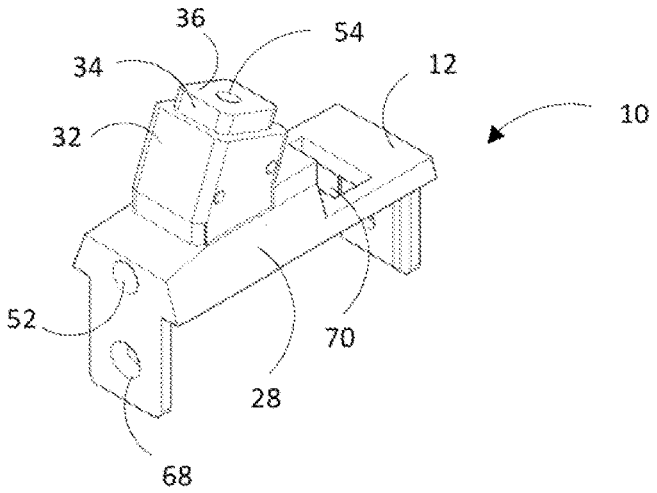
FIGS. 2*a*, 2*b*, 2*c*, and 2*d* illustrate a left perspective view, right perspective view, side view, and bottom view, respectively, of an exemplary airsoft adapter assembly according to one embodiment.
Figure 2B:
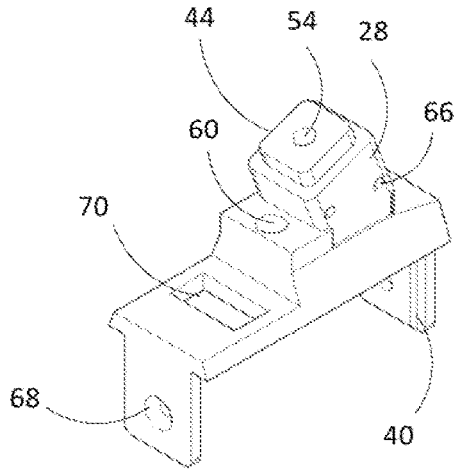
Figure 2C:
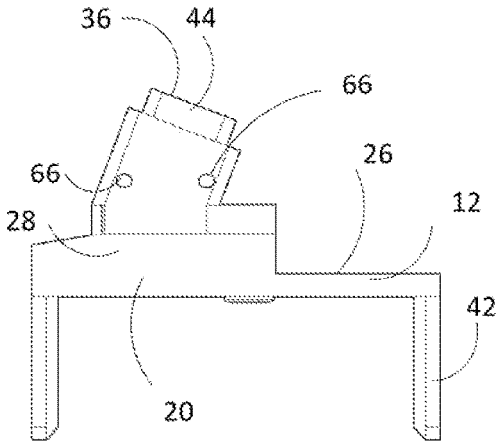
Figure 2D:
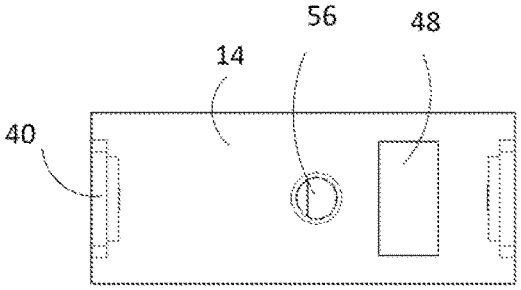
Figure 3A:
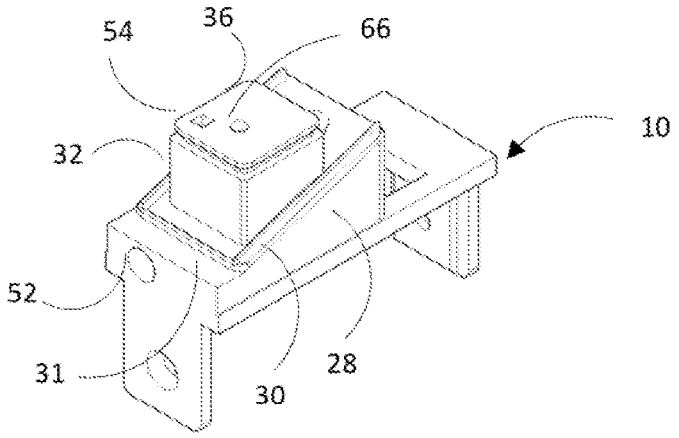
FIGS. 3*a*, 3*b*, 3*c*, and 3*d* illustrate a left perspective view, right perspective view, side view, and bottom view, respectively, of another embodiment of an airsoft adapter assembly.
Figure 3B:
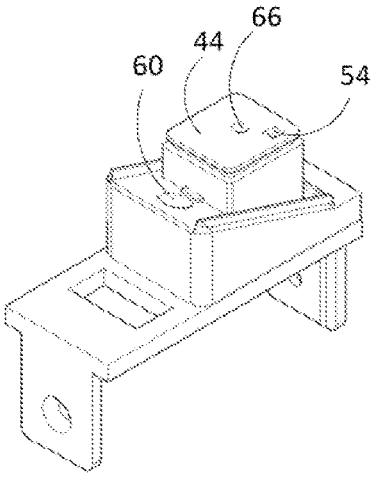
Figure 3C:
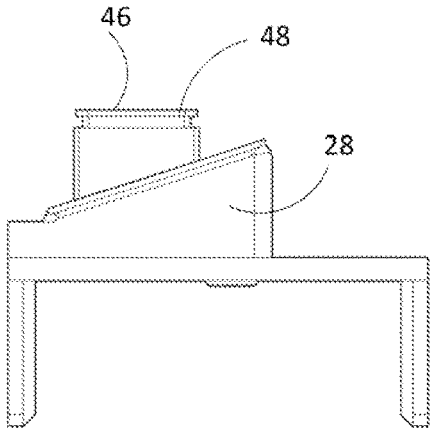
Figure 3D:
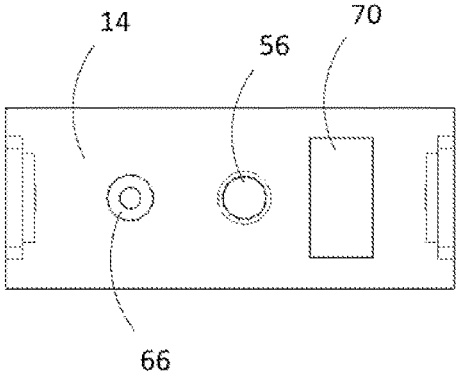
Figure 4A:
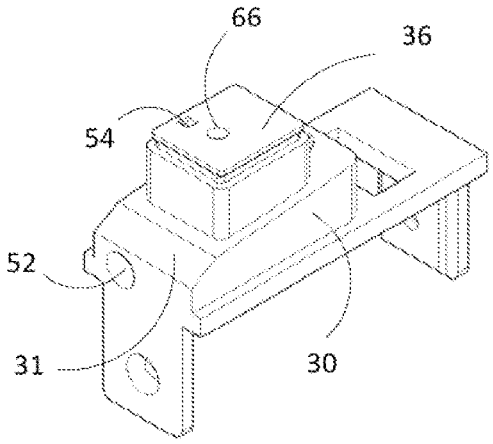
FIGS. 4*a*, 4*b*, 4*c*, and 4*d* illustrate a left perspective view, right perspective view, side view, and bottom view, respectively, of another embodiment of an airsoft adapter assembly.
Figure 4B:
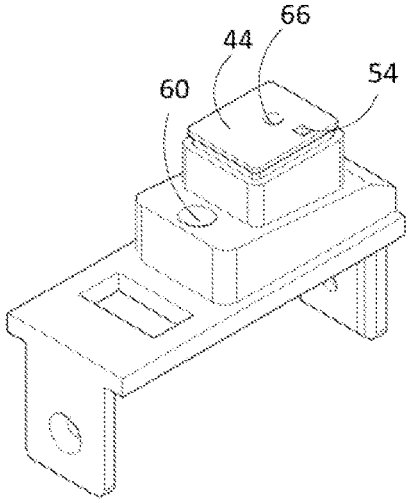
Figure 4C:
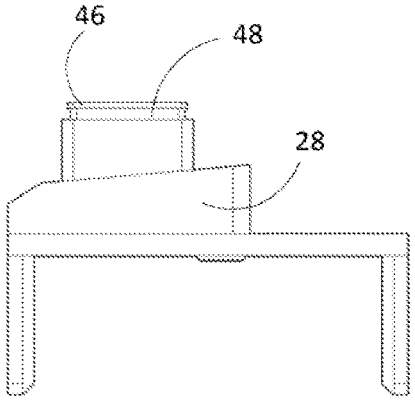
Figure 4D:
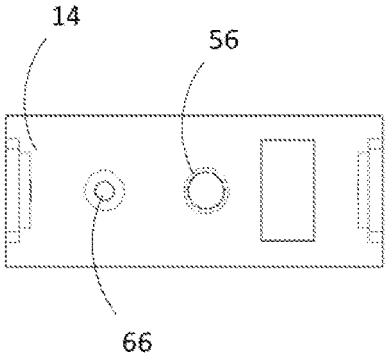
Figure 5A:
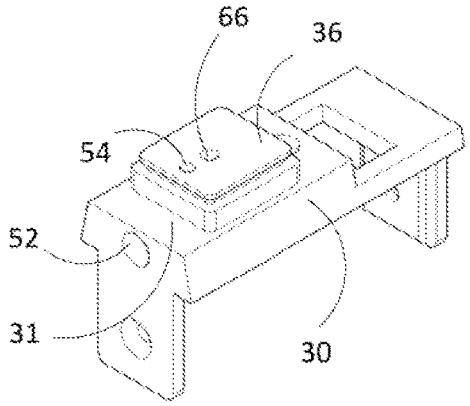
FIGS. 5*a*, 5*b*, 5*c*, and 5*d* illustrate a left perspective view, right perspective view, side view, and bottom view, respectively, of another embodiment of an airsoft adapter assembly.
Figure 5B:
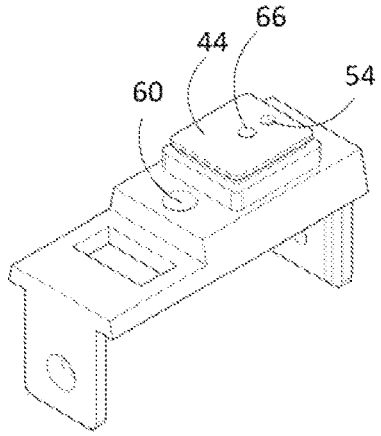
Figure 5C:
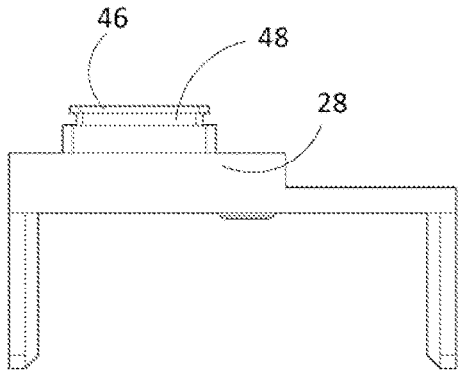
Figure 5D:
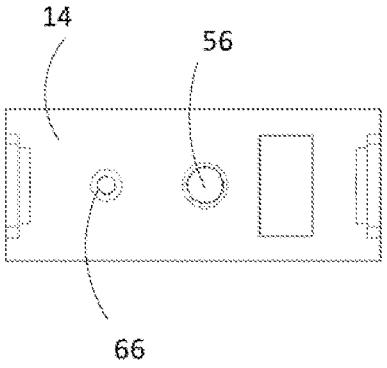
Figure 6A:
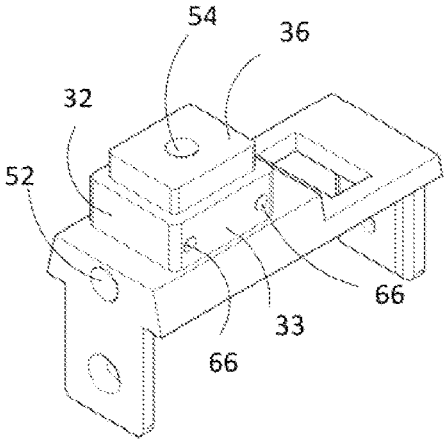
FIGS. 6*a*, 6*b*, 6*c*, and 6*d* illustrate a left perspective view, right perspective view, side view, and bottom view, respectively, of another embodiment of an airsoft adapter assembly.
Figure 6B:
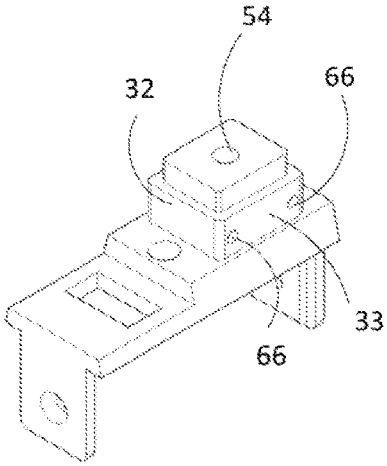
Figure 6C:
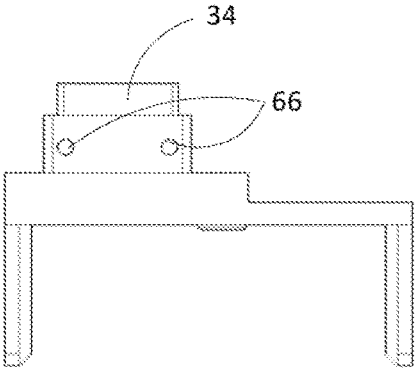
Figure 6D:
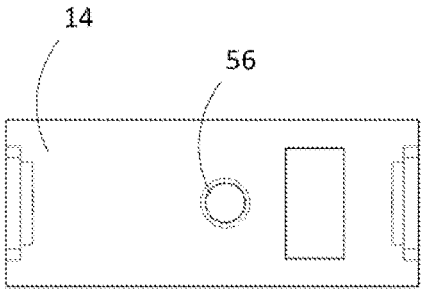
Figure 8A:
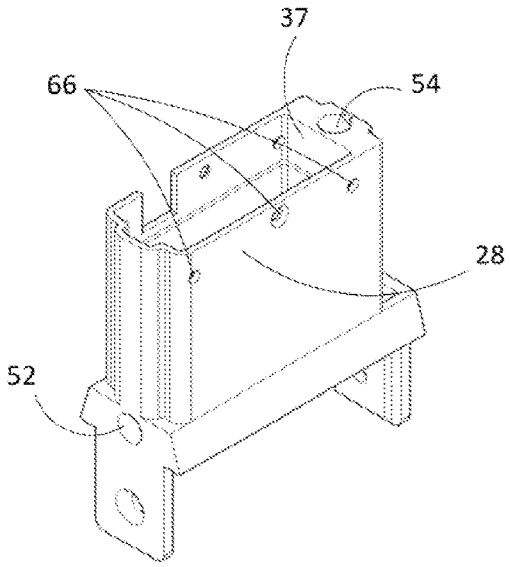
FIGS. 8*a*, 8*b*, 8*c*, and 8*d* illustrate a left perspective view, right perspective view, side view, and bottom view, respectively, of another embodiment of an airsoft adapter assembly.
Figure 8B:
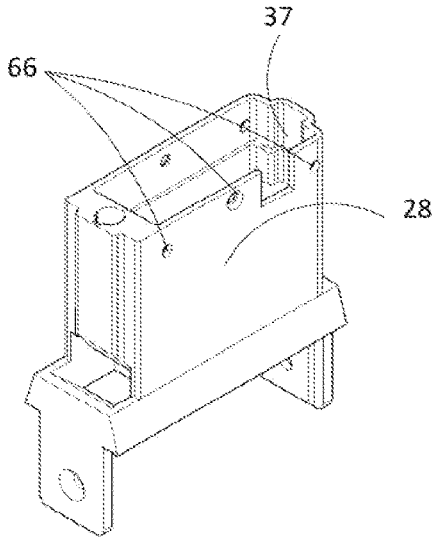
Figure 8C:
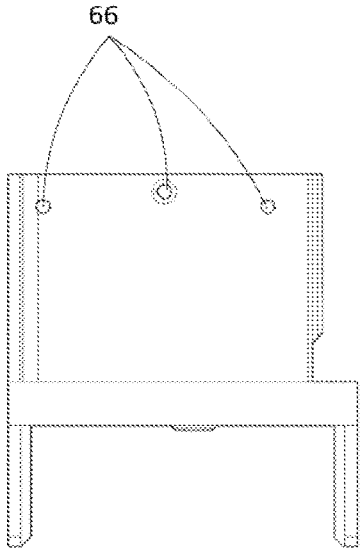
Figure 8D:
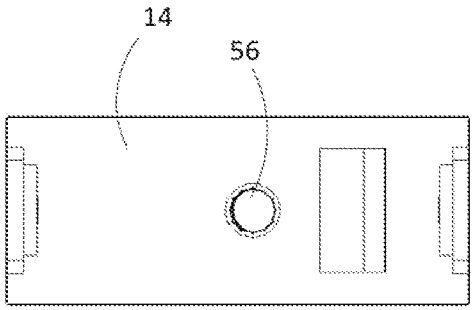
Figure 11A:
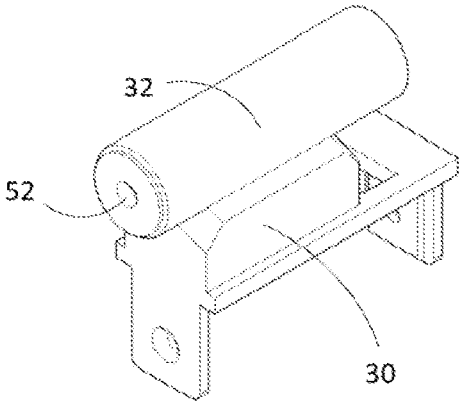
FIGS. 11*a*, 11*b*, 11*c*, and 11*d* illustrate a left perspective view, right perspective view, side view, and bottom view, respectively, of another embodiment of an airsoft adapter assembly.
Figure 11B:
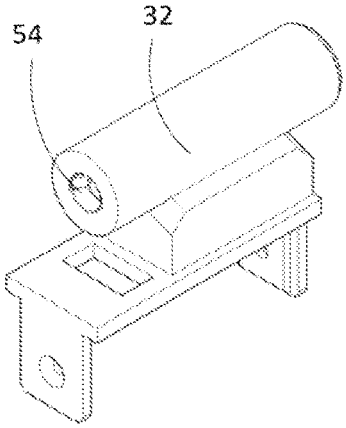
Figure 11C:
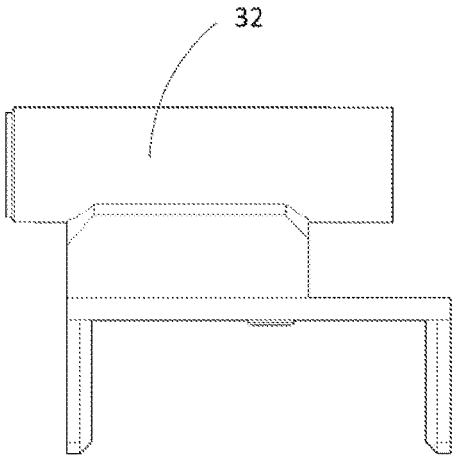
Figure 11D:
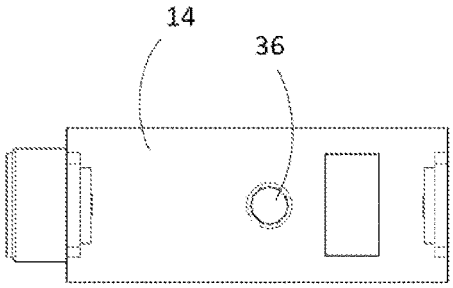
Figure 12A:
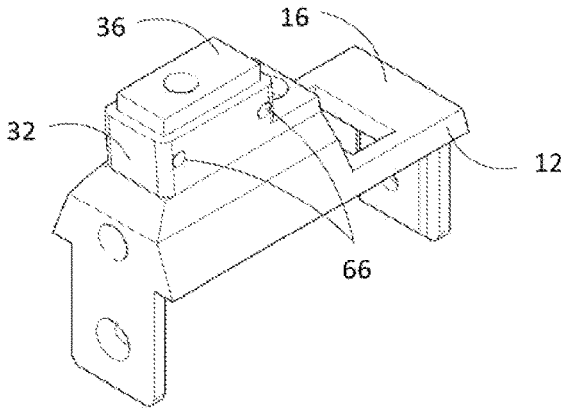
FIGS. 12*a*, 12*b*, 12*c*, and 12*d* illustrate a left perspective view, right perspective view, side view, and bottom view, respectively, of another embodiment of an airsoft adapter assembly.
Figure 12B:
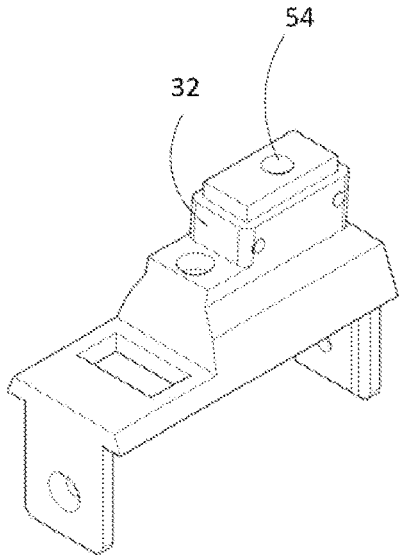
Figure 12C:
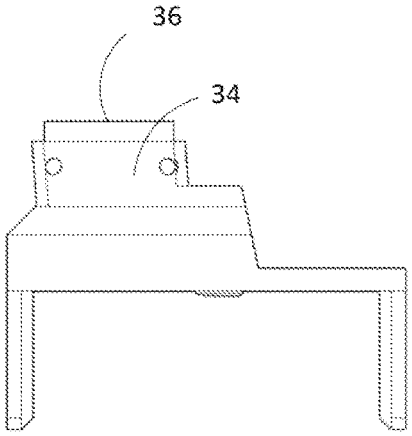
Figure 12D:
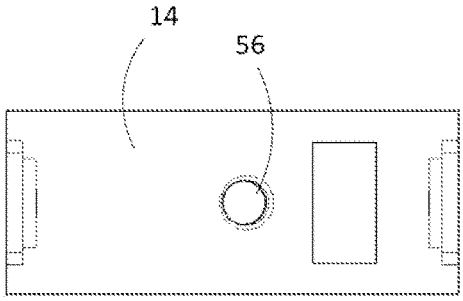
Figure 13A:
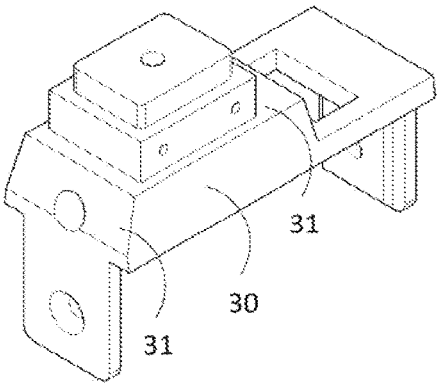
FIGS. 13*a*, 13*b*, 13*c*, and 13*d* illustrate a left perspective view, right perspective view, side view, and bottom view, respectively, of another embodiment of an airsoft adapter assembly.
Figure 13B:
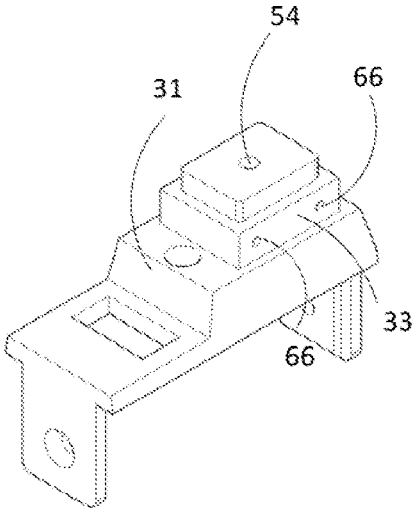
Figure 13C:
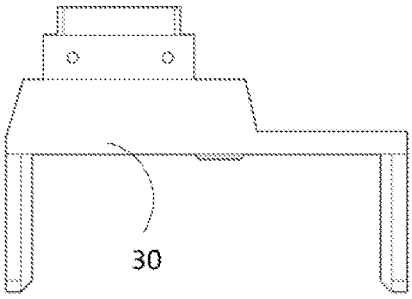
Figure 13D:
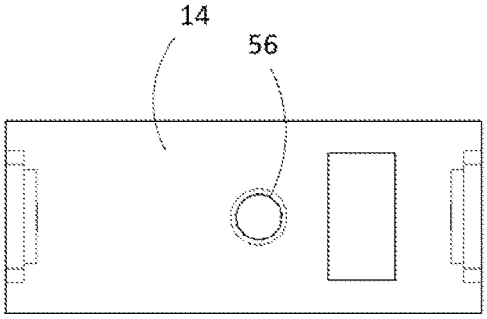
Figure 14A:
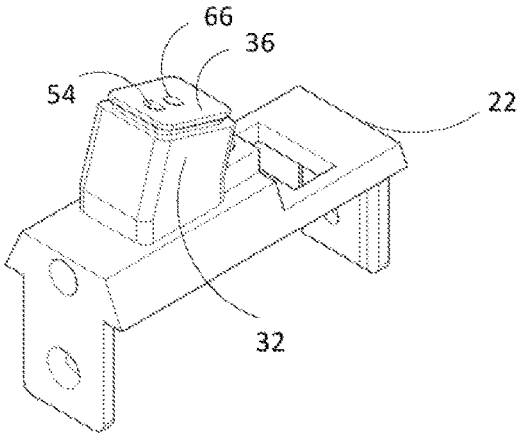
FIGS. 14*a*, 14*b*, 14*c*, and 14*d* illustrate a left perspective view, right perspective view, side view, and bottom view, respectively, of another embodiment of an airsoft adapter assembly.
Figure 14B:
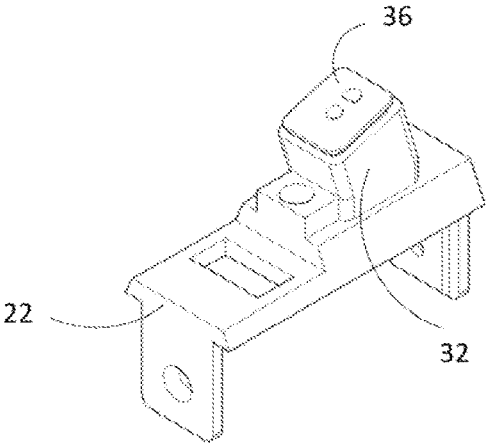
Figure 14C:
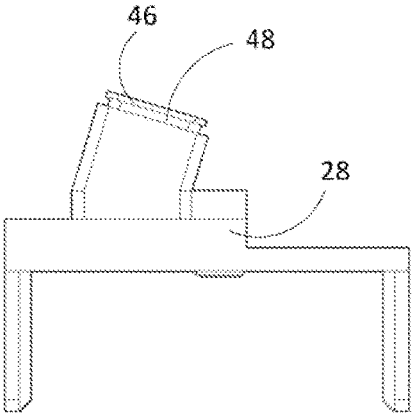
Figure 14D:
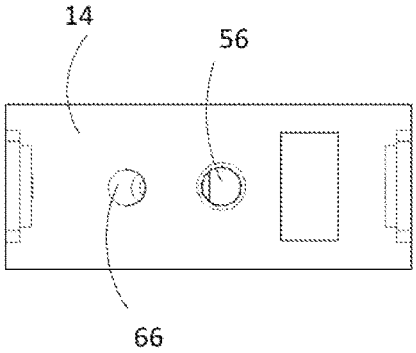
Figure 15A:
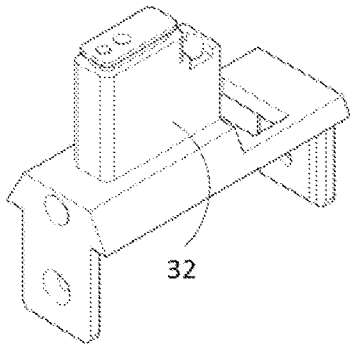
FIGS. 15*a*, 15*b*, 15*c*, and 15*d* illustrate a left perspective view, right perspective view, side view, and bottom view, respectively, of another embodiment of an airsoft adapter assembly.
Figure 15B:
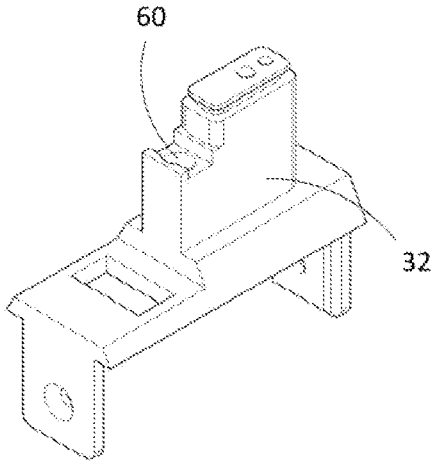
Figure 15C:
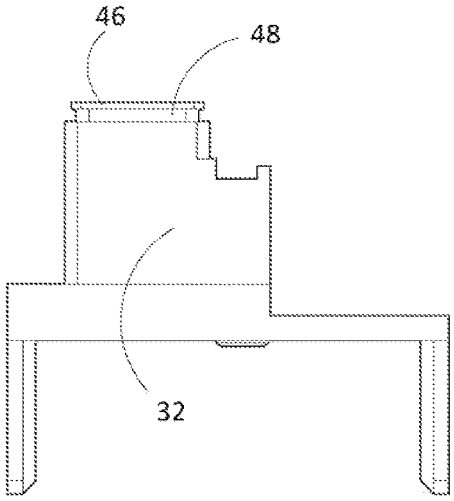
Figure 15D:
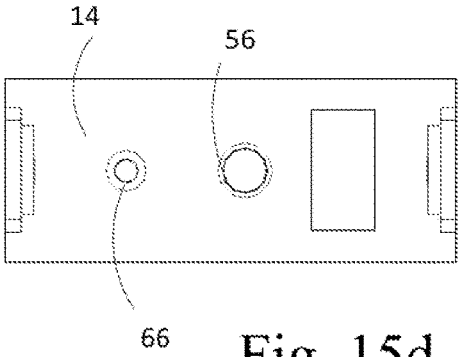
Figure 16A:
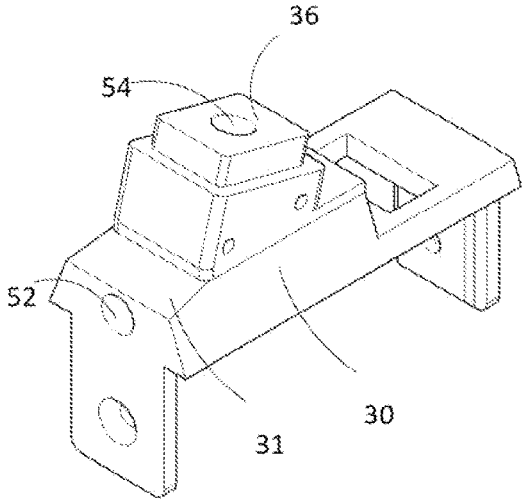
FIGS. 16*a*, 16*b*, 16*c*, and 16*d* illustrate a left perspective view, right perspective view, top view, and bottom view, respectively, of another embodiment of an airsoft adapter assembly.
Figure 16B:
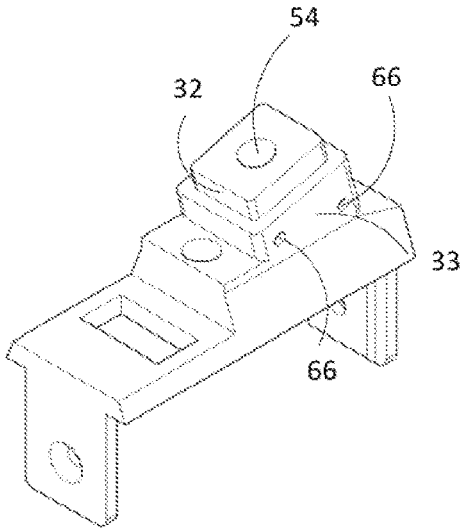
Figure 16C:
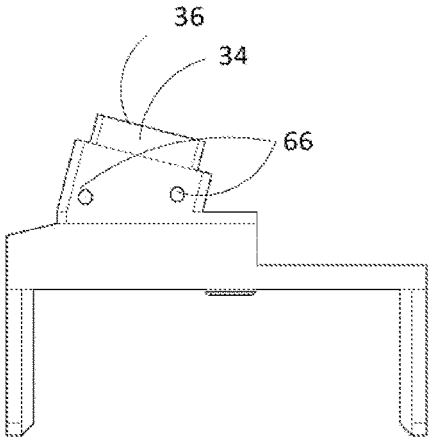
Figure 16D:
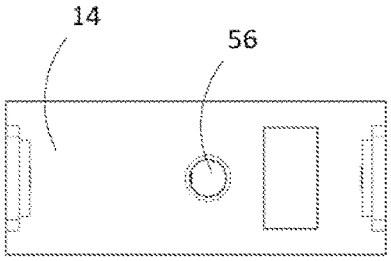
Figure 17A:
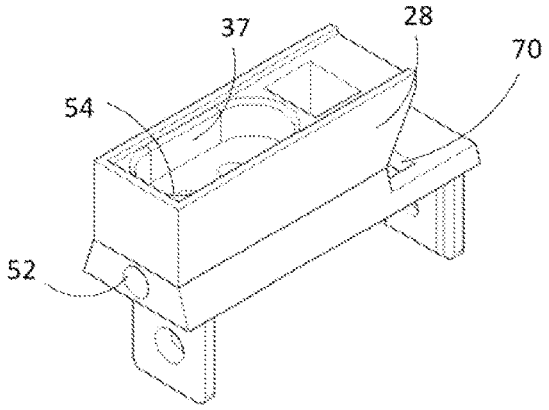
FIGS. 17*a*, 17*b*, 17*c*, and 17*d* illustrate a left perspective view, right perspective view, top view, and bottom view, respectively, of another embodiment of an airsoft adapter assembly.
Figure 17B:
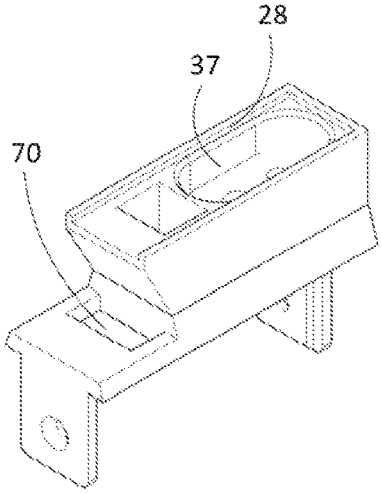
Figure 17C:
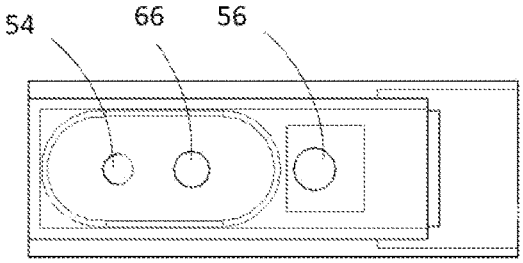
Figure 17D:
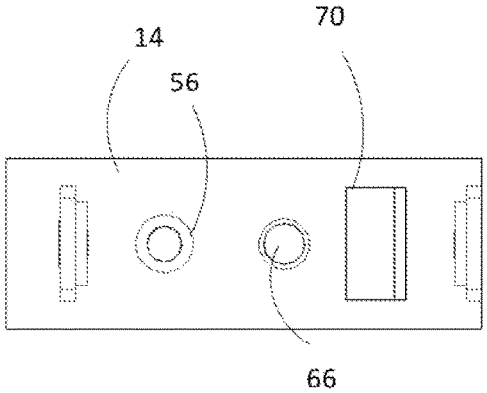

The projectile conduit 56 is arranged such that a vertical projection of the magazine fastening portion 28 partially covers the cross-section of the projectile conduit 46, as can be seen in FIG. 2*d*.

FIGS. 3*a*-3*d* show several views of an alternative exemplary airsoft adapter. The embodiment shown in FIGS.

3*a*-3*d* are based on the embodiment shown in FIGS. 2*a*-2*d*. Hence, the same definitions, explanations, and references apply where applicable.

The first protruding segment 30 of the magazine fastening portion 28 comprises a top surface 31 having a flat surface and an inclined surface. The second protruding segment 32 of the magazine fastening portion 28 protrudes vertically from the inclined surface. The third protruding segment 34 has the shape of a crown 44 with a crown edge 46 and a gasket groove 48.

The HPA inlet 52 has a circular cross-section and is positioned off-center. The HPA outlet 54 has a quadratic cross-section and is provided in a corner of the top surface 36 of the magazine fastening portion 28. The projectile conduit 56 runs next and in parallel to the second protruding segment 32.

The adapter 10 further comprises one magazine fastening hole 66 which runs vertically through the magazine fastening portion 28 and is oriented such that it runs substantially through the center of the top surface 36 of the magazine fastening portion 28.

FIGS. 4*a*-4*d* show several views of an alternative exemplary airsoft adapter. The embodiment of FIGS. 4*a*-4*d* is based on the embodiment of FIGS. 3*a*-3*d*. The present embodiment differs in that the first protruding segment 30 has a top surface 31 comprising a first inclined surface and a second inclined surface, and in that the first inclined surface has a greater inclination compared to the second inclined surface.

FIGS. 5*a*-5*d* show several views of an alternative exemplary airsoft adapter. The embodiment of FIGS. 5*a*-5*d* is based on the embodiment of FIGS. 4*a*-4*d*. The present embodiment differs in that the first protrusion 30 has a flat top surface 31.

FIGS. 6*a*-6*d* show several views of an alternative exemplary airsoft adapter. The embodiment of FIGS. 6*a*-6*d* is based on the embodiment of FIGS. 5*a*-5*d*. The present embodiment differs in that the adapter 10 comprises two magazine fastening holes 66, provided on each side surface 33 of the second protruding segment 32. The total number of magazine fastening holes may thus be four. Alternatively, the adapter 10 may comprise a total of two magazine fastening holes 66, extending through the second protruding segment 32 from one side surface 33 to the other. The third protruding segment 34 of the magazine fastening portion 28 is a straight protrusion with even side surfaces. The HPA inlet 52 and the HPA outlet 54 are centered.

FIGS. 7*a*-7*d* show several views of an alternative exemplary airsoft adapter. The embodiment of FIGS. 7*a*-7*d* is based on the embodiment of FIGS. 6*a*-6*d*. The present embodiment differs in that the top surface 31 of the first protruding segment 30 comprises an inclined section and in that the second protruding segment 32 is tilted.

FIGS. 8*a*-8*d* show several views of an alternative exemplary airsoft adapter. The embodiment of FIGS. 8*a*-8*d* is based on the embodiment of FIGS. 7*a*-7*d*. The present embodiment differs in that the magazine fastening portion 28 is configured such that a cavity 37 with an opening in the top surface 26 is formed, and in that the adapter 10 comprises three magazine fastening holes 66 on each side of the magazine fastening portion 28.

FIGS. 9*a*-9*d* show several views of an alternative exemplary airsoft adapter. The embodiment of FIGS. 9*a*-9*d* is based on the embodiment of FIGS. 7*a*-7*d*. The present embodiment differs in that the top surface 31 of the first protruding segment 31 has a flat section at the proximal end of the adapter, and in that the crown 44 comprises a crown edge 46 and a gasket groove 48.

FIGS. 10*a*-10*d* show several views of an alternative exemplary airsoft adapter. The embodiment of FIGS. 10*a*-10*d* is based on the embodiment of FIGS. 7*a*-7*d*. The present embodiment differs in that the top surface 31 of the first protruding segment 31 has a flat section at the proximal end of the adapter.

FIGS. 11*a*-11*d* show several views of an alternative exemplary airsoft adapter. The embodiment of FIGS. 11*a*-11*d* is based on the embodiment of FIGS. 10*a*-10*d*. The present embodiment differs in that the second protruding segment 32 has the shape of a cylinder running parallel to the base plate 12, wherein the HPA inlet 52 is provided on a front-facing cylinder surface, and wherein the HPA outlet 54 is provided on a back-facing cylinder surface.

FIGS. 12*a*-12*d* show several views of an alternative exemplary airsoft adapter. The embodiment of FIGS. 12*a*-12*d* is based on the embodiment of FIGS. 7*a*-7*d*. The present embodiment differs in that the second protruding portion 32 protrudes tilted towards the proximal end of the adapter, wherein the top surface 36 of the magazine fastening portion 28 is parallel to the top surface 16 of the base plate 12.

FIGS. 13*a*-13*d* show several views of an alternative exemplary airsoft adapter. The embodiment of FIGS. 13*a*-13*d* is based on the embodiment of FIGS. 6*a*-6*d*. The present embodiment differs in that the first protruding portion 30 comprises a top surface 31 which has a flat middle segment, and two inclined segments.

FIGS. 14*a*-14*d* show several views of an alternative exemplary airsoft adapter. The embodiment of FIGS. 14*a*-14*d* is based on the embodiment of FIGS. 5*a*-5*d*. The present embodiment differs in that the second protruding portion 32 protrudes in a tilted fashion, such that the top surface 36 of the magazine fastening portion 28 is inclined, leaning towards the distal end 22 of the adapter.

FIGS. 15*a*-15*d* show several views of an alternative exemplary airsoft adapter. The embodiment of FIGS. 15*a*-15*d* is based on the embodiment of FIGS. 5*a*-5*d*. The present embodiment differs in that the projectile conduit outlet 60 is provided in the second protruding segment 32.

FIGS. 16*a*-16*d* show several views of an alternative exemplary airsoft adapter. The embodiment of FIGS. 16*a*-16*d* is based on the embodiment of FIGS. 7*a*-7*d*. The present embodiment differs in that the top surface 31 of the first protruding segment 30 has a smaller inclination and in that the projectile conduit outlet 60 is provided on a stepped top surface of the second protruding segment 32.

FIGS. 17*a*-17*d* show several views of an alternative exemplary airsoft adapter. The embodiment of FIGS. 17*a*-17*d* is based on the embodiment of FIGS. 8*a*-8*d*. The present embodiment differs in that the HPA outlet 54 is provided on a top surface 36 of the magazine fastening portion 28, located inside the cavity 37. The adapter 10 further comprises one magazine fastening hole 66, which is provided also on the inside of the cavity 37.

FIG. 18 shows an exploded view of an exemplary adapter 10 and a magazine 74. An adapter-magazine complex can be formed by connecting the adapter 10 to a magazine 74. The adapter 10 is inserted into a magazine open end 76 and with a gasket 78 forming a sufficiently airtight seal between the adapter 10 and the magazine open end 76. A magazine distal end 72 will ultimately be inserted into the barrel of an airsoft gun. Furthermore, an external compressed air supply (not shown) will need to be attached to the adapter via an HPA fitting 80. The adapter 10 may be fastened to a magazine 74 via an elongated fastener 82 that may be treaded through the gas magazine fastener hole 66 of the adapter.

FIG. 19 shows an exploded view of an exemplary magazine-adapter complex and a reservoir 86. The adapter-magazine or magazine-adapter complex described in FIG. 18 is incorporated by reference. The adapter 10 is further connected to a reservoir 86. The adapter 10 is fitted onto a reservoir docking bay 88. A reservoir fastening screw 84 is threaded through a reservoir fastening hole 68 of the appendages and into a reservoir fastener hole 90 of the reservoir 86 to form a magazine-adapter-reservoir complex. Appendages 40, 42 on either side of an adapter 10 may each have a reservoir fastening hole 68.

FIG. 20 shows a perspective view of an exemplary airsoft gun with a magazine-adapter-reservoir complex. The magazine-adapter-reservoir complex described in FIG. 19 is incorporated by reference. The magazine 74 (not visible) connected to the adapter 10 is inserted into the barrel of an airsoft gun 92.

The airsoft gun 92 may be operated normally without needing any modifications to its core parts including the magazine. The magazine may be removed normally. The adapter 10 and connected reservoir will be released along with the magazine. The magazine can then be pulled away from the adapter if desired. The reservoir and the adapter may be removed from one another by removing all fasteners. The same reservoir may be replaced or a new reservoir may be attached.

Several embodiments of the present disclosure have been described. While this specification contains many specific implementation details, these should not be construed as limitations on the scope of any disclosures or of what may be claimed. The specification serves as descriptions of features specific to particular embodiments of the present disclosure.

Certain features that are described in this specification in the context of separate embodiments can also be implemented in combination in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Thus, particular embodiments of the subject matter have been described. Other embodiments are within the scope of the following claims. Nevertheless, it will be understood that various modifications may be made without departing from the spirit and scope of the disclosure.

What is claimed is:

1. An airsoft adapter, comprising:

a base plate with a proximal end and a distal end, a bottom surface, and a top surface, a magazine fastening portion provided on the top surface, a reservoir fastening portion provided on the bottom surface, an HPA conduit tunneling through the magazine fastening portion, and a projectile conduit tunneling through the base plate and the fastening portion, wherein the magazine fastening portion comprises at least two protruding segments in a stacked configuration, and at least one magazine fastening hole, wherein the HPA conduit has an elbow shape and comprises an HPA inlet provided on a proximal end surface of the magazine fastening portion, and an HPA outlet provided on a top surface of the magazine fastening portion, wherein the projectile conduit is a linear vertical tunnel and comprises a projectile inlet on a bottom surface and a projectile outlet on the top surface of the magazine fastening portion, and wherein the reservoir fastening portion comprises a proximal appendage and a distal appendage, wherein the reservoir fastening portion protrudes from the base plate.

2. The airsoft adapter of claim 1, further comprising a magazine fastening hole positioned on a second protruding segment between the HPA conduit on a proximal end and the projectile conduit on a distal end.

3. The airsoft adapter of claim 1, wherein the adapter comprises a first protruding segment, a second protruding segment, and a third protruding segment in a step-stacked configuration.

4. The airsoft adapter of claim 3, wherein the HPA conduit has an inlet at a proximal end surface of the first protruding segment, tunnels horizontally through the first protruding segment and bends to tunnel vertically through the second protruding segment and the third protruding segment to the HPA outlet present at a top surface of the magazine fastening portion of the third protruding segment at a position 2 mm from a proximal end of the third protruding segment.

5. The airsoft adapter of claim 4, further comprising a magazine fastening hole positioned distally to the HPA conduit and proximally from the projectile conduit parallel to the HPA conduit.

6. The airsoft adapter of claim 3, wherein an HPA conduit outlet is present on a surface of the second protruding segment, and a projectile conduit outlet is present on a surface of the third protruding segment.

7. The airsoft adapter of claim 6, wherein the second protruding segment has a width greater than a width of the third protruding segment but lesser than a width of the base plate.

8. The airsoft adapter of claim 3, wherein a projectile conduit outlet is present on a surface of the second protruding segment, and an HPA conduit outlet is present on a surface of the third protruding segment.

9. The airsoft adapter of claim 8, wherein the second protruding segment has a width greater than a width of the third protruding segment but lesser than a width of the base plate.

10. The airsoft adapter of claim 1, wherein the adapter comprises a first protruding segment and a second protruding segment in a step-stacked configuration.

11. The airsoft adapter of claim 10, wherein the first protruding segment has an angled top surface, and the second protruding segment has a flat top surface.

12. The airsoft adapter of claim 10, wherein the second protruding segment has an angled top surface, and the first protruding segment flat top surface.

13. The airsoft adapter of claim 1, further comprising a rectangular opening at a proximal end of a base plate top surface.

* * * * *